United States Patent [19]

Maki et al.

[11] Patent Number: 4,887,069

[45] **Date of Patent: * Dec. 12, 1989**

[54] PERIMETER INTRUSION DETECTION SYSTEM WITH BLOCK RANGING CAPABILITIES

[75] Inventors: Melvin C. Maki; Walter J. Feller, both of Kanata; Edward L. Adams, Nepean, all of Canada

[73] Assignee: Control Data Canada Limited, Ottawa, Canada

[ * ] Notice: The portion of the term of this patent subsequent to Nov. 7, 2006 has been disclaimed.

[21] Appl. No.: 116,587

[22] Filed: Nov. 4, 1987

[30] Foreign Application Priority Data

Nov. 6, 1986 [CA] Canada ..... 522372

[51] Int. Cl.[4] ..... G08B 13/18; H01P 3/00

[52] U.S. Cl. ..... 340/552; 333/237

[58] Field of Search ..... 340/552–554; 342/27–28; 333/237; 455/55

[56] References Cited

U.S. PATENT DOCUMENTS

| | | | |
|---|---|---|---|
| 3,829,767 | 8/1974 | Delogne | 455/152 |
| 3,947,834 | 3/1976 | Gershberg et al. | 340/554 |
| 3,975,700 | 8/1976 | Halstead | 333/237 |
| 4,091,367 | 5/1978 | Harman | 340/552 |
| 4,152,648 | 5/1979 | Delogne | 455/55 |
| 4,213,123 | 7/1980 | Poirier | 340/552 |
| 4,419,659 | 12/1983 | Harman et al. | 340/552 |
| 4,562,428 | 12/1985 | Harman et al. | 340/552 |
| 4,630,057 | 12/1986 | Martin | 342/358 |

FOREIGN PATENT DOCUMENTS 1530358 4/1978 Fed. Rep. of Germany .

*Primary Examiner*—Glen R. Swann, III
*Assistant Examiner*—Thomas J. Mullen, Jr.
*Attorney, Agent, or Firm*—Jones, Tullar & Cooper

[57] ABSTRACT

An intrusion detection system of the type using cables arranged along a perimeter to be protected and sensing changes in the electrical field around the cables caused by the presence of an intruder. The cables are divided into sections or blocks and typically only one of the sections is energized at any time. The variations caused by an intruder at the selected sections are transmitted through the intervening section to the receiver portion of a transceiver located at one end of the cables. This indicates in which section intrusion has occurred. The system uses continuous wave excitation whereby the expense and complexity of high speed switching and timing of r.f. signals are avoided.

21 Claims, 5 Drawing Sheets

PERIMETER INTRUSION DETECTION SYSTEM WITH BLOCK RANGING CAPABILITIES

BACKGROUND OF THE INVENTION

1. Field of the Invention

This application relates to perimeter intrusion detection systems of the type using the disturbance of an electromagnetic field around a cable to detect intruders. In particular, the invention relates to systems which establish the approximate location of an intruder or target detected by the system. The cables used in the systems of this invention are divided into sections or blocks and the system indicates in which section the intrusion has occurred. This is known as "block ranging".

2. Background Information

As an example of a perimeter intrusion detection system reference may be made to U.S. Pat. No. 4,091,367 (Canadian Patent No. 1,014,145) which teaches the use of a pair of leaky coaxial cables buried in the ground and extending around such a perimeter. The leaky cables disclosed in this patent have a series of apertures to permit coupling outside the cable. Apertures are not an essential feature of a leaky cable and other means may be used to provide the externally coupled field, e.g. diffusion through a thinner shield. A transmitter supplies r.f. energy to one of the leaky cables and a receiver is connected to the other. The field set up by the transmitting cable links with the receiving cable. The resulting signal at the receiver has a fixed component, known as "profile" plus a variable component formed by any change in the received energy resulting from the presence of a target. A signal processor at the receiver separates the profile and target signals, compares the target signal with a threshold and activates an alarm if the threshold is exceeded.

The magnitude of the target signal varies with position along the cable; the coupled energy in the vicinity of targets further away from the transmitter-receiver location being less due to cable attenuation. One manner of compensating for this unwanted variation in target signal is to grade the cable, by changing aperture size or distribution, so that more energy is coupled at locations remote from the transmitter and the target signal is then substantially independent of target location. Another manner of reducing variations in sensitivity with target location is to connect the receiver to the end of its cable which is remote from the transmitter so that the signal path length for any target position is constant. Sensing with this arrangement is termed co-directional sensing and sensing as originally described with the transmitter and receiver adjacent is termed contra-directional sensing.

By use of the timing of pulse return signals with contra-directional sensing as in conventional radar, the target location along the length of the cable pair may be determined. This can provide accuracy of the order of several meters on a cable length of about 800 m. if pulse interpolation or wide bandwidth is employed. Typically, however, the display will be divided in blocks of length 33–100 m. and the extreme accuracy is not required. Each block may have a different threshold to compensate for variations in sensitivity.

If a continuous wave r.f. signal is used then there is no target timing information on the received signal and only the presence of a target somewhere along the cable is determined. Cable length is typically limited to about 150 m. because of difficulty in compensating for sensitivity variations along the cable. Nevertheless, c.w. systems are attractive since the absence of pulse circuitry and r.f. switching leads to reduced cost. British Patent Specification No. 2,120,823 published Dec. 7, 1983, suggests dividing the perimeter into sectors each driven by a separate transmitter and receiver forming a remote terminal. A control unit is connected at one end of the cables and polls each of the remote terminals in turn to determine if any of the associated sectors have been intruded. Thus, block ranging is achieved by providing a separate cable and separate processing electronics for each block to be covered together with the control unit at one end of the cables. This results in increased cost and also requires some of the processing electronics to be operated remotely from the central control in a harsh external environment.

A system proposed in British Patent Specification No. 83 24686, in the name of Martin, uses switch boxes distributed periodically along a single leaky coaxial cable. A signal transmitted by a cooperating vehicle whose position is being tracked is modified by adding a marker pulse at each switch box. The base station determines vehicle location by counting the number of marker pulses. Clearly this system is not applicable to intruders.

The present invention involves the concept of switching alternative cable sections into active use, typically one at any time. A particular form of switching a cable section into and out of active use is disclosed in U.S. Pat. No. 4,213,123 to Poirier. Poirier provides a gate or "entry portal" by replacing a short section of the leaky cable used in a detection system by a conventional non-leaky cable during the period a vehicle will be entering so that there is no transmitted field at the gate. The patent is not concerned with the problem of providing block ranging of a target which is the concern of the present application.

In the previously discussed system of U.S. Pat. No. 4,091,367 the cables are buried beneath the surface of the ground in order to maintain the system covert. This has the added advantage that interaction of differing modes of electromagnetic propagation are largely avoided, since the ground is lossy. It is known that for leaky cables in air, these interacting modes can produce "mode cancellation", or standing waves which cause the sensitivity to targets to be non-uniform with distances along the cable length.

An alternative system is taught in applicant's copending application Serial No. 116,585, filed Nov. 4, 1987 using waves propagating along the outer conductor of a coaxial cable. Such waves are similar to those produced from the apertures of a leaky coaxial cable but without the disadvantage of interaction between them mentioned above. The use of such waves for communication purposes is disclosed in U.S. Pat. No. 3,829,767 issued Aug. 13, 1974 to Delogne. As an alternative to leaky coaxial cables Delogne teaches the use of ordinary coaxial cables with passive elements called mode converters inserted at intervals. These elements inserted in a normal non-leaky coaxial line couple some of the energy between the cable interior and exterior. The spacing distance is dependent on the attenuation of modes of propagation exterior to the cable, which vary typically from about 1 .dB/100' for cables in air to 1 .dB/foot for buried cables. As an illustration, spacings in air of about 300 ft. are possible.

As taught by Delogne two types of waves may be generated outside the coaxial cable, one which propagates radially away from the source and the other which is guided along the outer surface of the cable. It is this second type of wave which is used for obstacle or intrusion detection. Some embodiments of the present invention use a regular coaxial cable with spaced coupled wave devices, as opposed to a leaky coaxial cable. The function of these devices, hereinafter called CWD's, is to transfer r.f. energy efficiently from a transmission mode within the cable to a guided mode along the exterior of the cable with minimal undesirable reflections or transmission losses.

The block ranging system of this invention can be utilized both with leaky coaxial cables and with conventional cables having r.f. energy transmitted in a guided mode on the exterior of the cable. It requires only c.w. signals and does not involve the duplication of transceiver units. No high speed electronic switching and timing of r.f. pulses is required and relatively short blocks may be monitored.

SUMMARY OF THE INVENTION

The present invention relates to a perimeter intrusion detection system, comprising: first and second cables arranged along the perimeter and connected to a transceiver, each cable having a plurality of sections separated by switching units, each section defining a pair of adjacent paths, one path being a coaxial, well-shielded path and the other being an incompletely shielded or coupling path adapted to couple to an external field. The switching units on each cable are adapted to connect the coupling path of a selected single section of the first cable and the coupling path of the adjacent section of the second cable to the transceiver via the well-shielded paths of the intervening sections whereby the pair of selected sections are coupled by an external field and variations in the coupling detected at the transceiver indicate the presence of an intruder in the selected adjacent sections.

In another aspect, the invention relates to a perimeter intrusion detection system, comprising: a coaxial cable arranged along the perimeter and connected to a transceiver, the cable having a plurality of sections separated by switchable coupled wave devices, each device when enabled transferring energy between a transmission mode within the cable section and an external mode guided along the exterior of the cable section. Control means are provided to actuate only one of the switchable coupled wave devices at any time, whereby an external mode is established in a selected cable section and variations in the energy of the external mode are transmitted to the transceiver via the transmission mode of the intervening sections to indicate the presence of an intruder in the selected cable section.

In a further aspect, the invention relates to a perimeter intrusion detection system, comprising: a coaxial cable arranged along the perimeter and connected to a receiver, the cable having a plurality of sections each associated with a coupled wave device, each device when enabled transferring energy between an external mode guided along the cable section and a transmission mode within the cable, a plurality of oscillators positioned one at the end of each section opposite to the coupled wave device and adapted when energized to establish the external mode transferring energy through the coupled wave device back to the receiver via the intervening sections. A control unit is provided to actuate one of the oscillators at any time, whereby variations in the energy of the external mode of the selected section detected at the receiver indicate the presence of an intruder in the selected section.

In a still further aspect, the invention relates to a perimeter intrusion detection system, comprising: first and second leaky cables arranged along the perimeter, the first cable being connected to a control unit and the second cable being connected to a receiver, the first cable having a plurality of sections separated by oscillator units, each oscillator unit being associated with one section and adapted to transmit energy to the section, the control unit being adapted to selectively energize one of the oscillator units whereby the selected section of the first cable couples energy to the second cable and variations in this coupling detected at the receiver indicate the presence of an intruder in the selected section.

BRIEF DESCRIPTION OF THE DRAWINGS

The invention will become apparent from the following description of various embodiments taken in conjunction with the accompanying drawings, in which.

DESCRIPTION OF THE PREFERRED EMBODIMENTS

Figure 1:
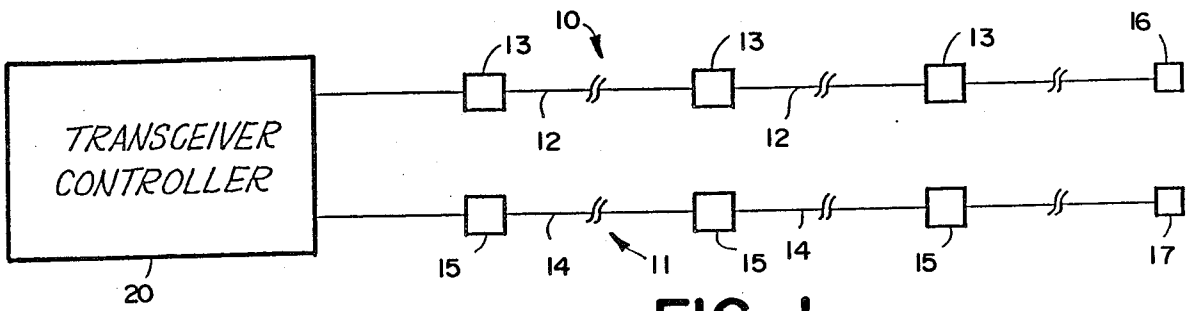
FIG. 1 is a schematic diagram of an intrusion detection system using separate transmitting and receiving cables.

FIG. 1 shows a perimeter intrusion detection system in which a transmitting cable 10 and receiving cable 11 terminating in matching loads 16 and 17 extend along the perimeter to be protected. Cable 10 consists of a series of identical sections 12 separated by switching units 13 and cable 11 consists of a series of identical sections 14 separated by switching units 15. A transceiver-controller unit 20 is connected to cables 10 and 11.

Figure 3A:
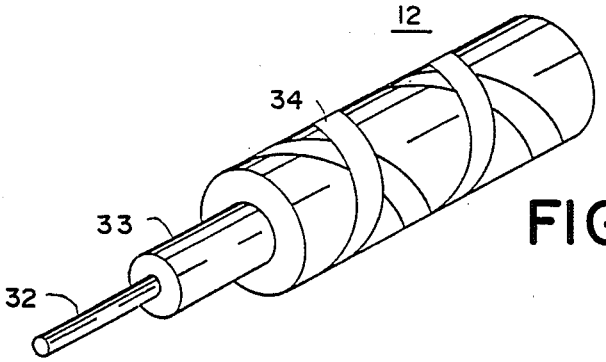
FIGS. 3A–3C shows different forms of cable sections useful in the system of FIG. 1.

Each of cable sections 12 and 14 defines both a well-shielded coaxial path and an incompletely shielded or coupling path which couples to an external field for detection. Specifically, referring to FIG. 3A, one embodiment of cable section 12 or 14 consists of a center conductor 32, a continuous shield 33 and an apertured or leaky shield 34 separated by appropriate dielectric layers. This cable structure results in any r.f. signal applied between conductor 32 and shield 33 being propagated in the normal coaxial mode whereas any signal applied between shields 33 and 34 is propagated as in a leaky coaxial cable.

Figure 2:
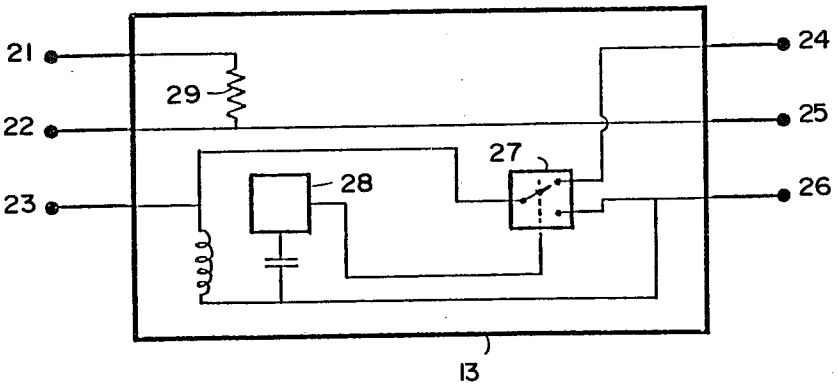
FIG. 2 is a schematic diagram of a switching unit used in the system of FIG. 1.

Switching unit 13, shown in FIG. 2, has input terminals 21, 22 and 23 and output terminals 24, 25 and 26. Input terminal 21 is connected to a load 29 and is adapted to terminate shield 34 of the preceding section in a matched load. Terminals 22 and 25 are directly connected and are adapted to be connected to shield 33 of each adjacent section. Terminal 23 is adapted to be connected to the center conductor of the preceding section and selectively connect it either to the center conductor of the following section, via terminal 26 or to the shield 34 of the following section, via terminal 24. Switch 27 actuated by control unit 28 selects one of these connections. Control unit 28 is actuated by signals sent along the central conductor with its shield as ground. Low frequency tones, pulse width modulation or pulse amplitude modulation may be used. A d.c. bypass circuit is provided between terminals 23 and 26 to provide the drive for the remaining control units. If it is preferred not to use a d.c. supply, the power for the control units can be obtained by rectifying the low frequency signal. Switch 27 can be relay, pin diode or other suitable r.f. switch.

Thus, in normal operation with switch 27 connecting terminals 23 and 26 the signal passes directly through the inner coaxial cable path. When switch 27 is actuated to couple terminal 23 to terminal 24 then the outer shield of the following section is energized and an external field is provided along that cable section. Since only one section of the cable is energized at any time, any signal representing an intruder received at transceiver 20 must come from that section and, hence, the location of the intruder is established.

Figure 3B:
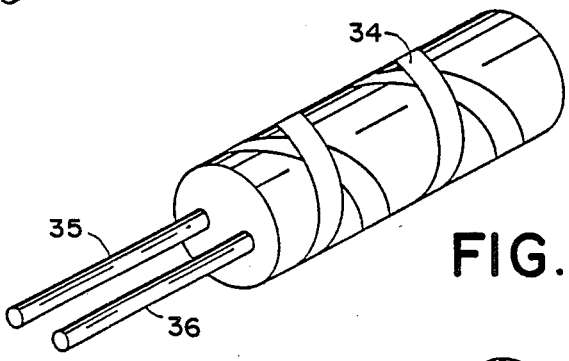
Figure 3C:
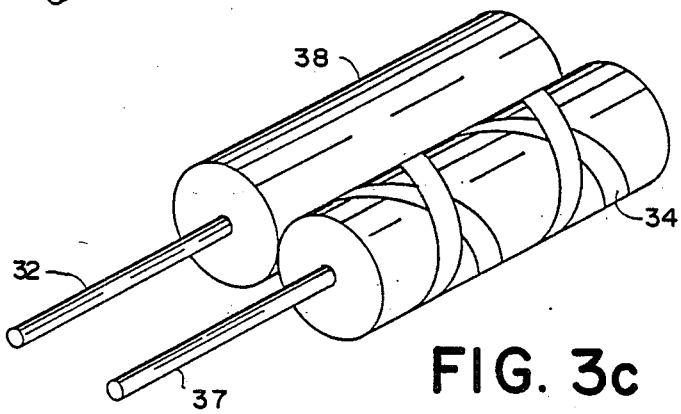

Alternative configurations for the cable sections 12 and 14 are shown in FIGS. 3B and 3C. In FIG. 3B a twin axial cable section is shown in which signals fed to the inner conductors 35 and 36 provide a balanced mode with little external field whereas signals fed between one inner conductor and the apertured or leaky shield 34 provide an external field. FIG. 3C shows the simple combination of a leaky and non-leaky coaxial cable in parallel, conductors 32 and 38 forming the ordinary coaxial cable and conductor 37 and apertured or leaky shield 34 forming the leaky coaxial cable. The cable must be designed for appropriate coupling, impedance and loss characteristics.

In order to compensate for cable attenuation losses when using identical cable sections the transmitter power or receiver gain of transceiver 20 can be increased as the section in use is further from control unit 20. Alternatively, the cable can be graded.

Figure 4:
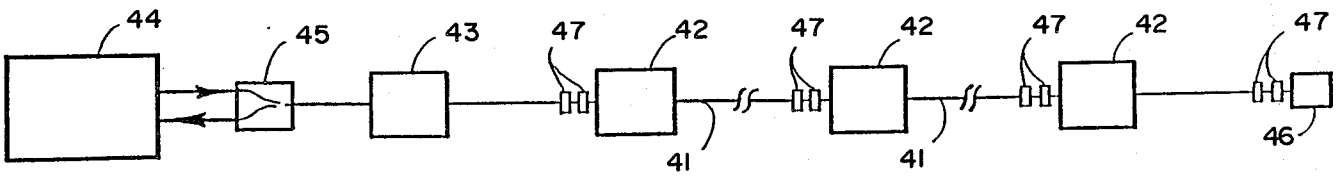
FIG. 4 is a schematic diagram of a different intrusion detection system using a single coaxial cable.

FIG. 4 shows another embodiment of the present invention, typically air mounted, using a single cable formed of sections 41 of normal coaxial cable configuration, that is they are not leaky coaxial cable. Cable sections 41 are separated by switching units 42 governed by a zone controller 43. A transceiver 44 is connected to the cable through a directional coupler or splitter 45. The cable is terminated in a matching impedance 46 and ferrite beads 47 positioned on the exterior at one end of each section 41 to attenuate any external wave launched along that section.

Figure 5:
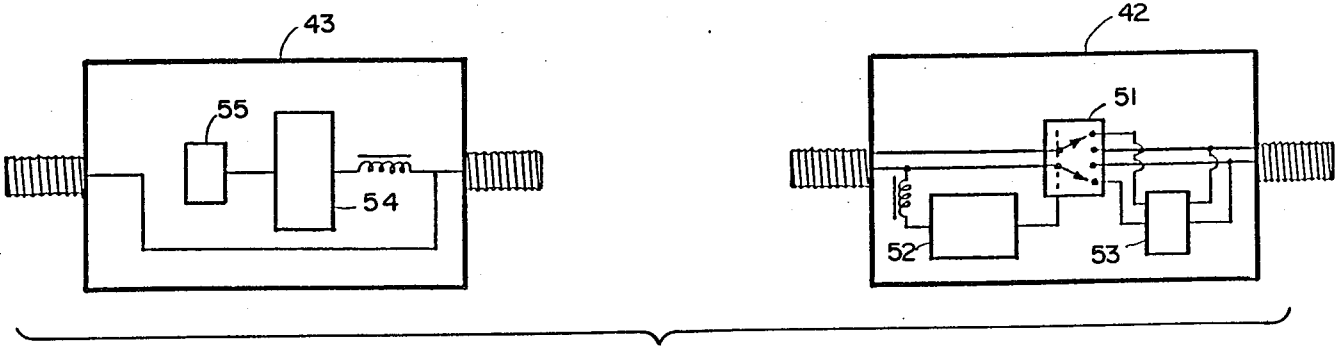
FIG. 5 is a schematic diagram of a zone controller and switching unit useful in the system of FIG. 4.

FIG. 5 shows details of the zone controller 43 and one switching unit 42 contained in an isolated or non-metallic box. In the switching unit 42 the signal on the central conductor of the coaxial cable is normally passed directly from input to output but may be interrupted by a switch 51 which passes the r.f. signal to a coupled wave device 53 which, in turn, launches an external wave along the shield of the coaxial cable. Switch 51 is a double-pole, double-throw switch and also connects the outer sheath to the CWD. Switch 51 is actuated under the control of a decoder unit 52 which senses low frequency tones supplied along the cable to identify the particular zone to be energized.

Zone control unit 43 contains the necessary tone encoder 54 controlled by a switching unit 55 for selecting the particular cable section to be energized. The selected tone is added to the r.f. signal from the transceiver which passes from input to output of zone controller 43. When a particular CWD is connected in circuit by switch 51 it not only launches the external wave on the cable but also passes any reflected energy from the wave back within the coaxial cable for transmission to transceiver 44.

Figure 6:
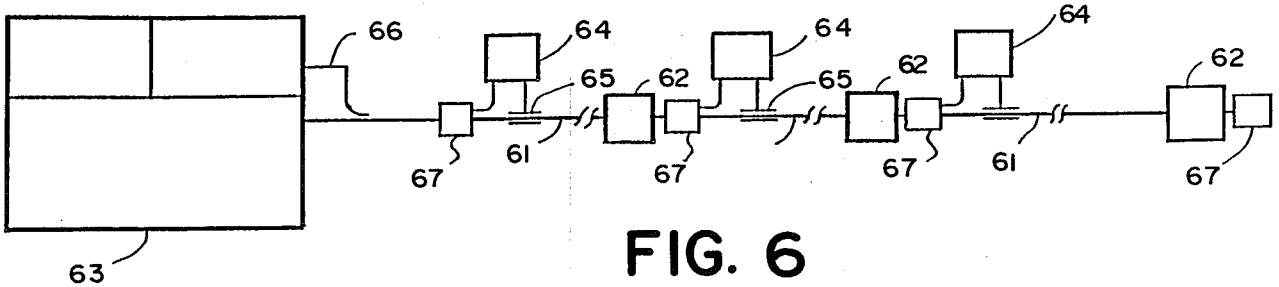
FIG. 6 is a schematic diagram of a still further intrusion detection system using a single coaxial cable.

FIG. 6 shows a further embodiment in which the cable sections are again normal coaxial cable, that is not leaky coaxial cable, but the surface wave is launched not internally from a coupled wave device but from a separate external oscillator and coupler on each section. Specifically, the cable is formed in sections 61 separated by coupled wave devices 62. The function of devices 62 is to transmit any received energy to the cable for transmission back to a receiver 63. The external guided mode along the cable is launched by oscillator units 64 coupled to the exterior of the cable at positions 65. A matched load 67 is positioned at the end of each section to terminate the external guided mode from the corresponding oscillator at that point. Ferrite beads may be used in conjunction with the matched load to ensure the extinction of the wave. Oscillator units 64 are enabled, one at any time, by signals sent along messenger wire 66 or other conductors along with the supply voltage.

Figure 7:
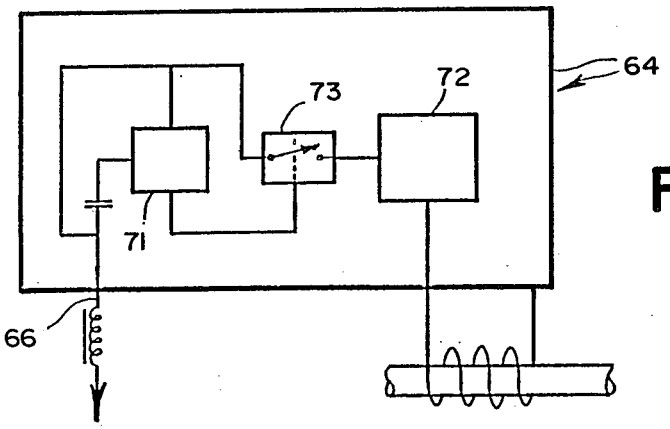
FIG. 7 is a schematic diagram of an oscillator unit used in the system of FIG. 6.

FIG. 7 shows more detail of an oscillator unit 64. A decoder 71 is connected to the messenger wire and is responsive to a selected signal to actuate switch 73 thereby supplying power to oscillator 72. The presence of an intruder alters the energy coupled between an oscillator unit 64 and the termination of its corresponding section of cable thereby altering the energy arriving at coupled wave device 62 for transmission back to receiver 63.

Figure 8:
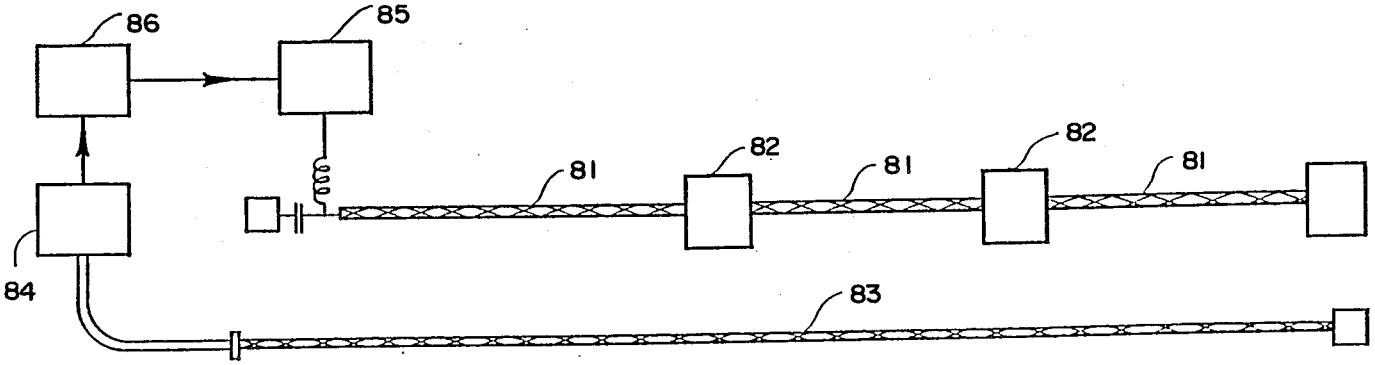
FIG. 8 is a schematic diagram of another intrusion detection system using a pair of leaky coaxial cables.

FIG. 8 shows a still further embodiment using leaky coaxial cables. The first cable consists of leaky coaxial cable sections 81 separated by oscillator units 82. Only one unit 82 and thus only one section of the cable is energized at any time. A second leaky cable 83 extends alongside the first around the perimeter to be protected and is connected to a receiver 84. It will be seen that the presence of an intruder adjacent an energized section 81 of the first cable alters the coupling between it and receiving cable 83 thereby indicating the presence of the intruder. Encoder 85 controlled by control unit 86 supplies the tone signal to identify the selected section. Since only one section 81 is energized at any time the particular section in which the intruder is located is thereby established.

Figure 9:
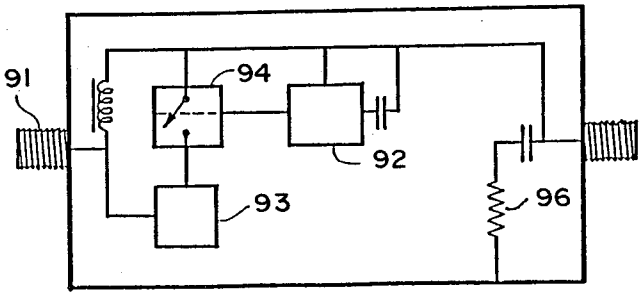
FIG. 9 is a schematic diagram of an oscillator unit useful in the system of FIG. 8.

FIG. 9 shows more detail of the oscillator unit 82. The incoming signal at terminal 91 carries a low frequency tone control signal supplied to decoder 92. Decoder 92 when activated actuates switch 94 to supply power to oscillator 93. The r.f. signal from oscillator 93 is supplied to the preceding section 81 via terminal 91. An r.f. termination 96 prevents energization of the following sections.

The concept of the receiving cable being a leaky coaxial cable, such as cable 83, can also be used in conjunction with switched CWD lines as shown in FIGS. 1, 4 and 6 used to couple to the receiving leaky coaxial cable.

The systems shown in FIGS. 6 and 8 which employ oscillators at locations along the cable away from the central section cannot easily use synchronous detection since no local oscillator is available at the receiver. Although the resulting lower signal to noise ratio for this configuration may be a disadvantage in some circumstances these systems can be constructed economically and, since only d.c. switching is needed for the oscillators, the complexity of r.f. switching is avoided.

Thus, there has been described various perimeter intrusion detection systems each using cables divided into a number of sections. A form of time division multiplexing is employed under the control of the central station to ensure that only one section of each cable is active at any one time. As a result a separate profile (fixed component of the received signal) can be maintained for each section and separated out at the receiver. Adequate time and average power must be available for each section taking into account the shortest duration an intruder will be in the active area. This limits the maximum number of sections and sets a minimum processing speed.

The type of c.w. detection system disclosed in this application is much more economical in transceiver construction than the pulse ranging systems of the prior art. Only a single central receiver station is required. Those systems employing waves guided on the exterior of the coaxial cable use ordinary cable which is significantly less expensive than leaky coaxial cable. Compensating for signal attenuation by altering transmitter power or receiver gain is more economical than providing graded leaky coaxial cable. Similarly, altering the coupling characteristics of spaced C.W.D.'s is more economical than providing graded leaky coaxial cable. If grade cables are to be used then providing short identically graded sections is more economical than long cables graded along their length.

A particular system constructed in accordance with FIG. 4 used a line length of 900 ft. of cable supported 5 ft. above ground on posts at 30 foot spacing had three CWD units 300 ft. apart adjusted to give detection in only one direction from the CWD. Tests by a standard walk along the line indicated that when only one zone was excited detection was well confined to that single zone. A dead zone was also constructed to simulate a gate and provided a sharply defined ending to the detection zone. Switching time for discrete zones is dependent on the number of zones, the detection zone width, and the maximum target speed to be detected. For a 10 m/sec. target, a 1 m wide detection zone, and 5 zones, the on-time/zone is typically 10 m/sec. with an allowance of 1–2 m/sec. for switching times.

It will be apparent to those skilled in the art that several variations of the disclosed embodiments are possible without departing from the inventive concept. As taught in the copending application identified above, both co-directional and contra-directional coupling can be used.

Air mounted cables can be used in conjunction with buried leaky cables or in conjunction with a central antenna. That is, the first cable of FIG. 1 or FIG. 8 could be arranged along a circular perimeter and the second cable replaced by an antenna at the center of that perimeter. If the first cable is divided into four sections, for example, then the system can locate the quadrant in which a target is present. Similarly, the single cables of FIGS. 4 and 6 could be used to establish a guided wave along the cable coupling with an antenna at the center connected to the receiver.

The system of FIG. 8 employs a messenger wire since cables are frequently supplied with one to provide tensile strength in aerial configurations and using this as a conductor avoids extra circuitry for superimposing and separating d.c., low frequency and r.f. signals. All signals and the d.c. power can be carried on the center conductor if desired.

The spaced switching units can be used for additional features such as providing a connection point for branching detector lines or for a data link from other sensors located in the vicinity. They can also be used to provide directionality to the system, for example by using a pair of C.W.D.'s spaced at $\frac{1}{4}$ which launches a surface wave only in one direction, as described in the copending application, previously identified.

We claim:

1. A perimeter intrusion detection system, comprising:

first and second cables arranged along the perimeter and connected to a transceiver, each cable having a plurality of sections separated by switching units, each section defining a pair of adjacent paths, one path being a well-shielded path and the other being an incompletely shielded path adapted to couple to an external field, each switching unit being adapted to connect the incompletely shielded path of a selected single section of the first cable and the incompletely shielded path of a selected adjacent section of the second cable to said transceiver via the well-shielded paths of the intervening sections whereby the pair of selected sections are coupled by the external field and variations in the coupling detected at the transceiver indicate the presence of an intruder in the are of the selected sections.

2. A system as set out in claim 1 wherein each cable section consists of a parallel arrangement of a coaxial cable and a leaky coaxial cable.

3. A system as set out in claim 2 wherein the coaxial cable is in the interior of the cable section and the leaky coaxial cable conductors are the shield of the coaxial cable and a surrounding leaky shield.

4. A system as set out in claim 2 wherein the leaky coaxial section is graded.

5. A system as set out in claim 2 wherein said switching unit includes a switch which normally connects the coaxial cable of one section to the following shielded segment and when actuated connects the coaxial cable of one section to the leaky coaxial cable of the following section.

6. A system as set out in claim 1 wherein each cable section consists of a pair of twin axial conductors surrounded by an apertured shield.

7. A system according to claim 1 wherein said transceiver includes a source of continuous wave r.f. energy.

8. A perimeter intrusion detection system, comprising:

a coaxial cable arranged along the perimeter and connected to a transceiver, said cable having a plurality of sections separated by switchable coupled wave devices, each device when enabled transferring energy between a transmission mode within the cable section and an external mode guided along the exterior of the cable section, control means selectively actuating one of said switchable coupled wave devices, whereby an external mode is established in a selected cable section and the energy reflected from the external mode is transmitted to the transceiver via the transmission mode of the intervening sections so that variations therein indicate the presence of an intruder adjacent the selected cable section.

9. A system as set out in claim 8 wherein the switchable coupled wave devices are controlled by low frequency signals transmitted along the cable from the control means.

10. A system as set out in claim 8 wherein the coupled wave devices are arranged to increase the amplitude of energy supplied to the external mode with distance from the transceiver so as to compensate for cable attenuation.

11. A perimeter intrusion detection system, comprising:

a coaxial cable arranged along the perimeter and connected to a receiver, said cable having a plurality of sections each associated with a coupled wave device, each device when enabled transferring energy between an external mode guided along the cable section and a transmission mode within the cable, a plurality of oscillators positioned one at the end of each section opposite to the coupled wave device and adapted when energized to establish said external mode transferring energy through said coupled wave device back to said receiver via the intervening sections, a control unit actuating one of said oscillators at any time, whereby variations in the energy of the external mode of the selected section detected at the receiver indicate the presence of an intruder, adjacent the selected section.

12. A system as set out in claim 11 wherein the oscillators are controlled by low frequency signals transmitted along a messenger wire from the control unit.

13. A system as set out in claim 11 wherein one of the sets of oscillators and coupled wave devices are arranged to increase the amplitude of energy associated with the external mode with distance from the receiver, to compensate for cable attenuation.

14. A system according to claim 11, wherein said oscillators are a source of continuous wave r.f. energy.

15. A perimeter intrusion detection system, comprising:

first and second leaky cables arranged along the perimeter, the first cable being connected to a control unit and the second cable being connected to a receiver, said first cable having a plurality of sections separated by oscillator units, each oscillator unit being associated with one section and adapted to transmit energy to the section, said control unit being adapted to selectively energize one of said oscillator units to couple energy to a selected section of the first cable and thence to the second cable, whereby variations in the coupling detected at the receiver indicate the presence of an intruder adjacent the selected section.

16. A system as set out in claim 15 wherein the oscillator units are controlled by low frequency signals transmitted along the cable.

17. A system as set out in claim 15 wherein said second cable is graded for increased coupling with distance from the receiver to compensate for cable attenuation.

18. An intrusion detection system comprising:

a leaky cable arranged along the perimeter and connected to a control unit, an antenna within the perimeter connected to a receiver, said cable having a plurality of sections separated by oscillator units, each oscillator unit being associated with one section and adapted to transmit energy to the section, said control unit being adapted to selectively energize one of said oscillator units to couple energy to a selected section of the first cable and thence to the antenna, whereby variations in the coupling detected at the receiver indicate the presence of an intruder adjacent the selected sections or antenna.

19. A system as set out in claim 18 wherein the oscillator units are controlled by low frequency signals transmitted along the cable.

20. A perimeter intrusion detection system, comprising:

a coaxial cable arranged along the perimeter and connected to a transmitter, said cable having a plurality of sections separated by switchable coupled wave devices, each device when enabled transferring energy between a transmission mode within the cable section and an external mode guided along the exterior of the cable section, an antenna within the perimeter connected to a receiver, control means selectively actuating one of said switchable coupled wave devices, whereby an external mode is established in a selected cable section and the energy coupled to the antenna so that variations in the coupling detected at the receiver indicate the presence of an intruder adjacent the selected cable section.

21. A perimeter intrusion detection system, comprising:

a coaxial cable arranged along the perimeter and connected to a transmitter, said cable having a plurality of sections separated by switchable coupled wave devices, each device when enabled transferring energy between a transmission mode within the cable section and an external mode guided along the exterior of the cable section, a leaky coaxial cable arranged along the perimeter and connected to a receiver, control means selectively actuating one of said switchable coupled wave devices, whereby an external mode is established in a selected cable section and the energy coupled to the leaky coaxial cable so that variations in the coupling detected at the receiver indicate the presence of an intruder adjacent the selected cable section.

* * * * *